US006086487A

United States Patent [19]

Morgan et al.

[11] Patent Number: 6,086,487

[45] Date of Patent: Jul. 11, 2000

[54] METHOD FOR MATCHING GOLFER WITH A BALL

[75] Inventors: William E. Morgan, Barrington, R.I.; Mary Lou Bohn, Dover, Mass.

[73] Assignee: Acushnet Company, Fairhaven, Mass.

[21] Appl. No.: 09/283,967

[22] Filed: Apr. 2, 1999

[51] Int. Cl.[7] ..... A63B 57/00

[52] U.S. Cl. ..... 473/407; 473/131; 473/278; 473/289; 473/292; 473/385; 473/409

[58] Field of Search ..... 473/351, 131, 473/407, 409, 289, 278, 292, 385

[56] References Cited

U.S. PATENT DOCUMENTS 5,713,803 2/1998 Oshima ..... 473/407

5,864,960 2/1999 DeNicolo et al. ..... 33/508

*Primary Examiner*—Lee Young
*Assistant Examiner*—Rhonda Reid
*Attorney, Agent, or Firm*—Pennie & Edmonds LLP

[57] ABSTRACT

A method for selecting a golf ball whose performance characteristics match a golfer's critical playing characteristics for the purpose of reducing the golfer's score. The method comprises the steps of determining a golfer's critical playing characteristics, prioritizing ball performance characteristics, and selecting a golf ball from a predetermined set of golf balls which best matches the golfer's critical playing characteristics to ball performance characteristics.

20 Claims, 13 Drawing Sheets

METHOD FOR MATCHING GOLFER WITH A BALL

FIELD OF THE INVENTION

The present invention generally relates to custom methods for fitting a golfer with golfing equipment suited to that golfers individual critical playing characteristics. More specifically, the present invention relates to an interactive method of matching a golfer with a particular golf ball designed to achieve ultimate scoring performance.

BACKGROUND OF THE INVENTION

Methods of custom fitting a golfer to the most suitable golf ball, taking into account the golfer's individual swing characteristics, are well known within the golf industry. For example, the testing laboratory at the Acushnet Golf Center in New Bedford, Mass., has been measuring and analyzing the swing characteristics and ball launch conditions of thousands of golfers since the early seventies, as described in a special editorial report in the October 1980 issue of Golf Digest. As a result of this and more recent testing, Acushnet has developed an accurate method of matching a golfer with particularized golfing equipment, including golf balls. This method utilizes sophisticated equipment that measures golf ball launch conditions while the golfer hits golf balls of different construction and performance characteristics with a variety of drivers having variations in head and shaft characteristics. A camera monitors the golfer's swing by tracking the movement of a cluster of reflective dots of the golf ball. The camera has strobe lights that emit light immediately at two different times immediately after the club hits the ball. The light reflects off the reflective dots and is captured by the camera and sent to a computer for processing. This data is then recorded and analyzed using complex mathematical models which are able to calculate, among other things, the distance that a golf ball travels when struck off the tee by the golfer with a driver. From this information, the most appropriate golf ball can be determined for that specific golfer's swing. Although this methodology accurately matches a golfer to a golf ball, it requires the use of expensive electronic measuring equipment not always readily available.

Spalding® has developed the System C and System T golf balls which are designed specifically for use with the Callaway® Great Big Bertha driver (System C) and the Taylor Made® Ti Bubble 2 driver (System T). However, the Spalding® system fails to consider key variables such as the golfer's swing speed, club loft angles, and shaft flex. Additionally, the club/ball matching system is really only intended to aid in maximizing golf ball distance, not to aid in selecting a golf ball that will help a golfer score better based on their critical playing characteristics. The Spalding® system selects one ball for all golfers to play, regardless of their ability. Similarly, Dunlop® has proposed a method which matches a player's swing speed to a particular ball compression. However, this method fails to consider the golfer's playing ability, their critical playing characteristics, design of the club head, and the type and flex of the shaft.

An article in the May, 1958 issue of Golf Digest, entitled "Choose the right ball for your game", presents a ball-fitting method based solely on golf ball compression. It is suggested simply, that a 'good player' play high compression golf balls, an 'average player' play medium compression golf balls, and 'high scorers' play low compression golf balls. This system of matching compression to ability is directed to enhancing ball distance. A definition of what defines the caliber of player, such as swing speed, distance, or handicap, is not discussed. Additionally, the type of game the golfer plays and the critical golf ball playing characteristics of the golfer, such as spin, feel, and durability, are not considered.

A 1978 publication by the AMF Ben Hogan Company, entitled "The Amazing Golf Ball", presents a discussion of the history and evolution of the golf ball and the characteristics that potentially influence a golfer's game, such as dimples (aerodynamic forces of lift and drag), types of covers (balata versus durable), types of centers (solid versus liquid), manufacturing methods and influence of golf balls (causing out of balance, out of round, and weight distribution problems), elasticity, and compression. Golfers are encouraged to simply choose between a balata or durable cover, followed by a selection of compression—no advice is given on making these selections and the golfer's type of game, skill level, handicap, distance, etc. are not considered.

An April, 1995 article in Golfing Magazine, entitled "Golfing's Ball-fitting Guide", presents a cursory overview of some factors to consider when selecting a golf ball. These include the golfer knowing the strengths and weaknesses of their game and, with this in mind, considering three-piece or two-piece construction, dimple shape (shallow versus deep), type of golf club shaft, golf ball price, and comfort level. Types and groups of golf balls are not presented and narrowed to a particular ball, and the ability of the player and their ball preferences are not considered.

U.S. Pat. Nos. 4,063,259 and 4,375,887 disclose a method for matching a golfer with golf balls having varying aerodynamic properties. The launch conditions of the golf ball are measured to determine the golf ball dimple pattern most suitable for a particular golfer.

U.S. Pat. No. 5,713,803 discloses a golf ball-containing package having a section defined for indicating the performance of a golf ball. Sub-sections of the chart are selectively marked to indicate the golf ball structure, recommended head speed, feel, spin, green targeting, and trajectory.

Other simple golf ball fitting methods have been developed for use on a web site. Titleist®, for example, asks the golfer to answer a few simple questions about their golf game and preferred golf ball characteristics. Maxfli® has come up with a similar questionnaire that asks golfers using their web site to answer a few questions about golf ball preferences and the distance they typically hit the ball.

A common feature of the above golf ball fitting methods is their focus on increasing distance. This result alone is relied upon to help improve a golfer's game. None of the above methods, however, adequately meets the demand for a simple, yet accurate, golf ball fitting method, that takes into account a golfer's playing ability, type of shot that could most be helped by a correctly-fit golf ball, or the golfer's critical playing characteristics. The current invention is directed to helping golfers score better and in the most efficient manner, by matching the golfer's ability with their preferred golf ball performance characteristics and their critical playing characteristics.

SUMMARY OF THE INVENTION

The current invention is directed to a method for selecting a golf ball from a predetermined set of golf balls including the steps of determining a golfer's critical playing characteristics, prioritizing ball performance characteristics, and selecting a golf ball from the set of golf balls which best matches the golfer's critical playing characteristics for the purpose of reducing the golfer's score. In one embodiment, the step of determining the golfer's critical playing characteristic includes an interactive plurality of questions. In a preferred embodiment, the golfer's critical playing characteristic is determined from a plurality of playing characteristics including one or more of the following: shot distance for a predetermined club, shot shape, shot accuracy, shot consistency, and short game ability.

The step of prioritizing the ball performance characteristics preferably includes an interactive process of evaluating the opposing ball characteristics. Opposing ball performance characteristics may include one or more of the following: distance, spin, durability, and feel. In one embodiment, the step of evaluating the opposing ball performance characteristics includes comparing at least one of a first group of characteristics including spin and feel versus at least one of a second group of characteristics including durability and distance to determine the ball performance characteristics.

In one embodiment, the golfer is identified as having a typical shot shape selected from the following: golfers who work the ball, golfers with a consistent shot shape and golfers with an uncertain shot shape. Golfers with an uncertain shot shape may be further subdivided to those having minor directional variations and are able to keep the ball in play and those who simply have difficulty keeping the ball in play. In a preferred embodiment, a ball performance characteristic is selected by the golfer expressing a preference of golf ball spin versus golf ball durability.

More preferably, the golf ball performance characteristic is selected by the golfer expressing a preference of golf ball spin versus golf ball distance. Most preferably, the ball performance characteristic is selected by the golfer expressing a preference of golf ball feel versus golf ball distance.

In another embodiment, the golfer's critical playing characteristic of shot accuracy is evaluated by considering one or more of a drive or an approach shot. In a further embodiment, the golfer's critical playing characteristic of shot accuracy is evaluated by considering whether a successful approach shot consists of one or more of hitting close to the pin or hitting the green. Preferably, the golfer's critical playing characteristic of shot accuracy is evaluated by considering whether a typical drive consists of one or more of hitting the fairway or is out of play.

In a preferred embodiment, the steps of determining the golfer's critical playing characteristic and prioritizing ball performance characteristics is performed by a CD-ROM programmed to present a golfer with a series of questions about their golf game that aids in identifying said golfer's style of play and golf ball performance needs. In another embodiment, the steps of determining the golfer's critical playing characteristic and prioritizing ball performance characteristics is performed by a world wide web site programmed to present a golfer with a series of questions about their golf game that aids in identifying said golfer's style of play and golf ball performance needs. In still another embodiment, the steps of determining the golfer's critical playing characteristic and prioritizing ball performance characteristics is performed by using a computer program stored on one or more of a plurality of data storage devices.

The invention is also directed to a golf ball fitting system for matching a golfer to a particular golf ball selected from a predetermined set of golf balls including a computing device, an input device associated with the computing device for receiving input from a golfer and transmitting it to said computing device, a computer program associated with said computing device and said input device comprising at least a first means for determining the golfer's critical playing characteristics, a second means for determining and prioritizing ball performance characteristics, and a third means for selecting a preferred ball from the set of balls to best match the golfer's critical playing characteristics and ball performance characteristics.

In one embodiment, the first means further comprises means for determining the golfer's critical playing characteristic through a plurality interactive questions, wherein the critical playing characteristic includes one or more of the following playing characteristics: shot distance for a predetermined club, shot shape, shot accuracy, shot consistency, and short game ability. In another embodiment, the second means further comprises means for evaluating opposing ball performance characteristics; wherein the opposing ball performance characteristics comprise one or more of the following: distance, spin, durability, and feel.

In still another embodiment, the second means further includes a means for expressing a preference of golf ball spin versus golf ball durability, a means for expressing a preference of golf ball spin versus golf ball distance, or a means for expressing a preference of golf ball feel versus golf ball distance.

DESCRIPTION OF THE PREFERRED EMBODIMENTS

The current invention is directed to a method for selecting a golf ball from a predetermined set of golf balls, comprising the steps of determining a golfer's critical playing characteristics from the following: drive distance, approach shot accuracy, and short game ability, prioritizing the golf ball performance characteristics by comparing at least one of spin and feel versus at least one of durability and distance, and selecting a golf ball from the set of golf balls to best fit the golfer's critical playing characteristics and golf ball performance characteristics for the purpose of reducing the golfer's score.

In a preferred embodiment, a compact disc (CD-ROM) is created or a world wide web (www) site is set up to present a golfer with a series of questions about their golf game that aids in identifying said golfer's style of play and golf ball performance needs. The series of questions determining the golfer's critical playing characteristics and ball performance characteristics may also be in printed form such as a brochure.

Figure 1:
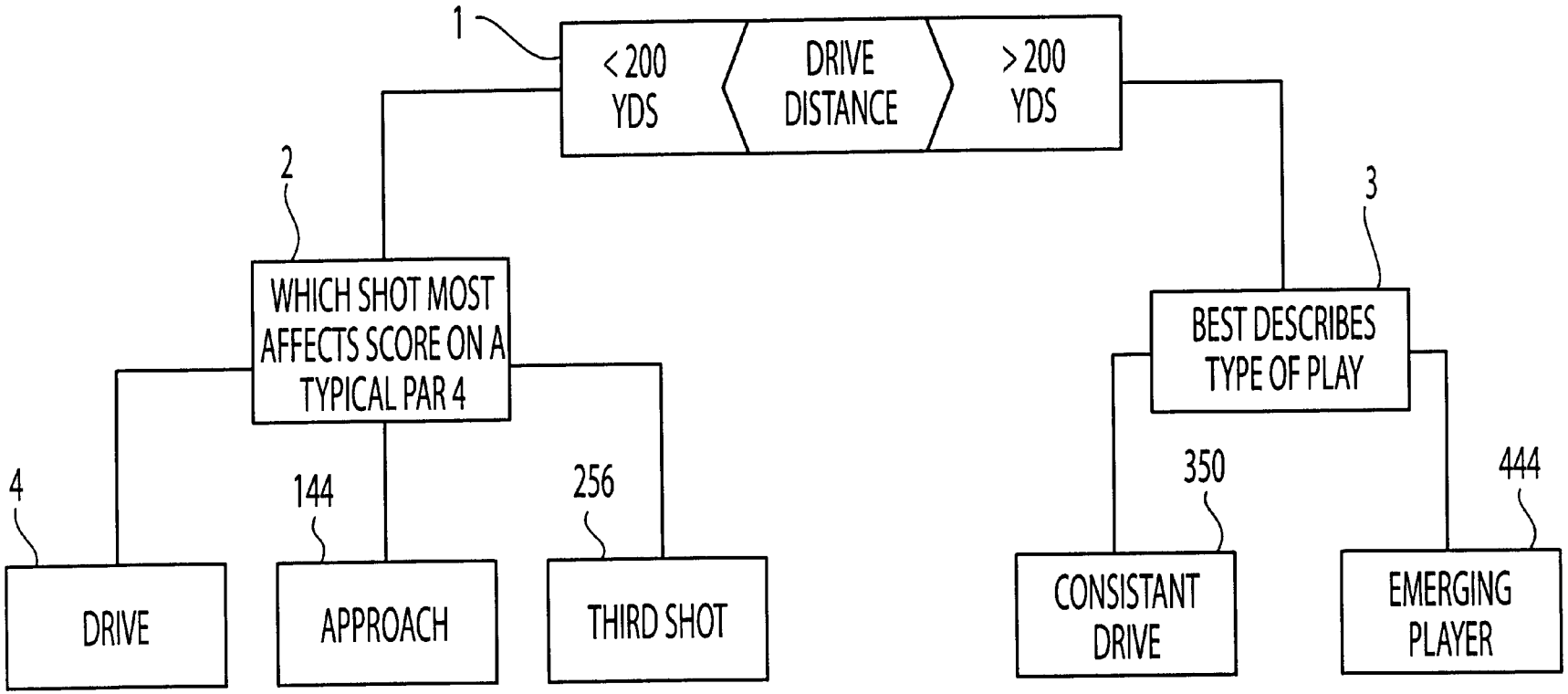
FIG. 1 is a decision tree having five categories of potential golfer responses.
Figure 2A:
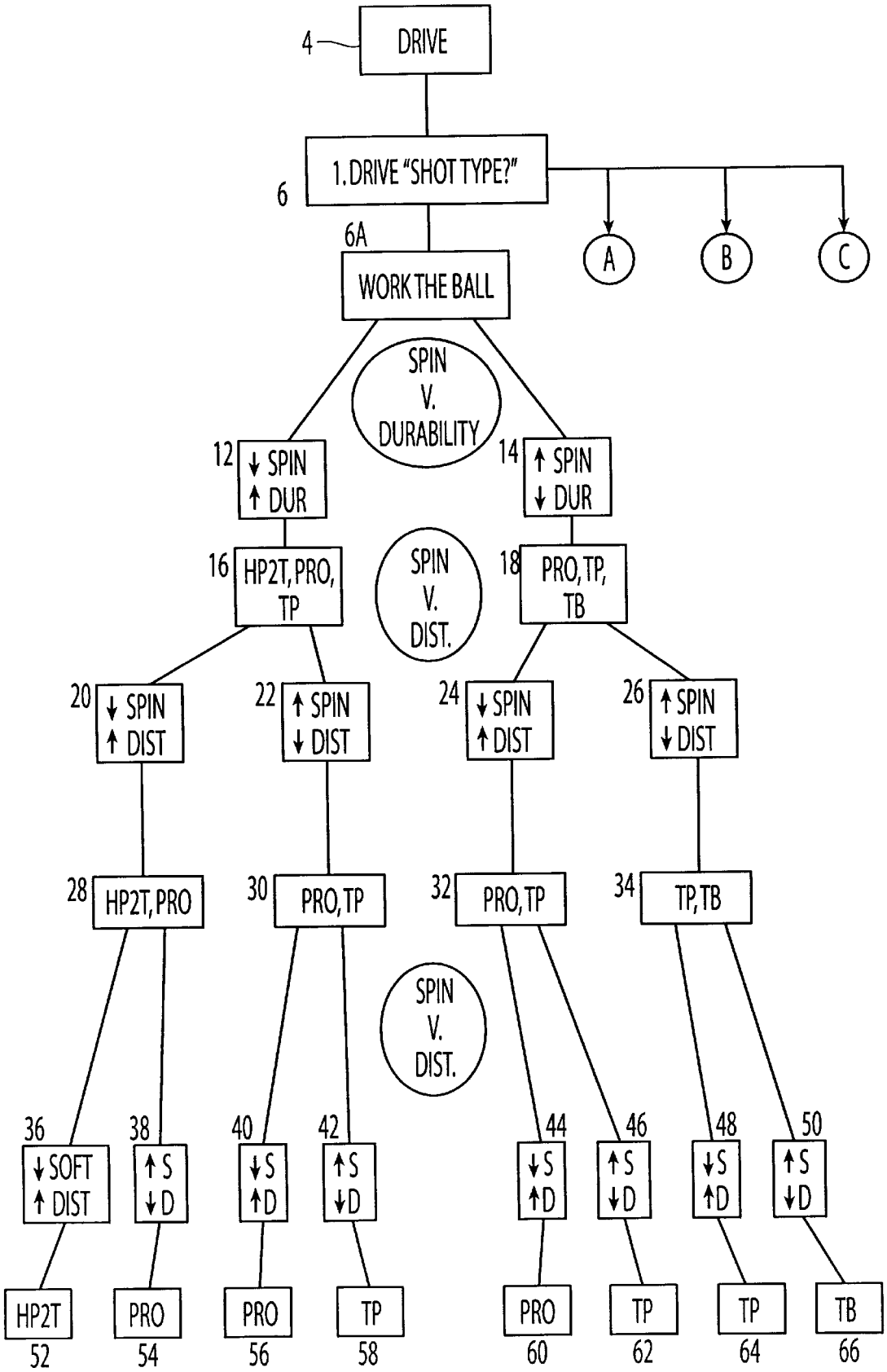
FIG. 2 is a decision tree depicting the first potential response of FIG. 1.
Figure 2B:
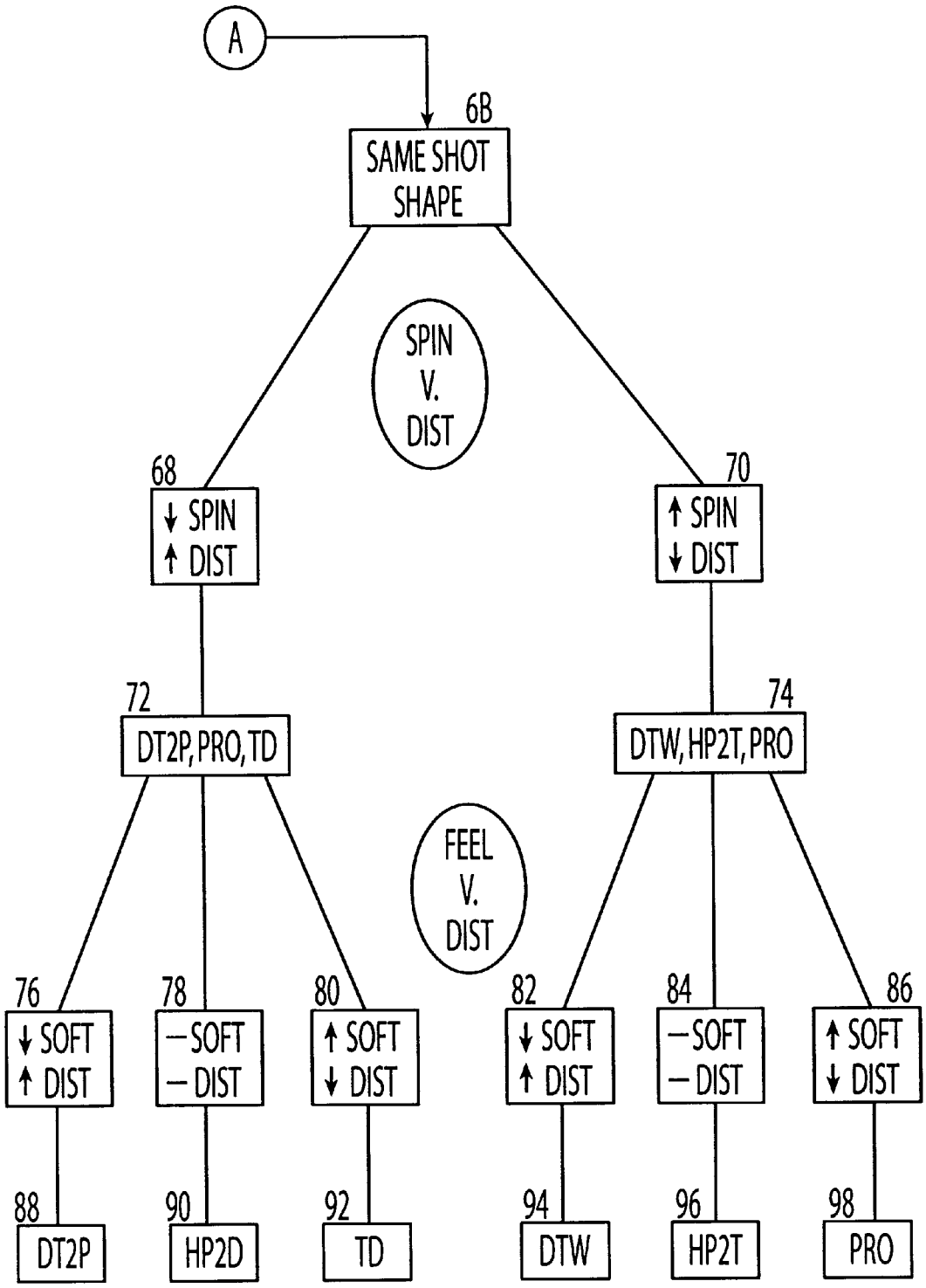
Figure 2C:
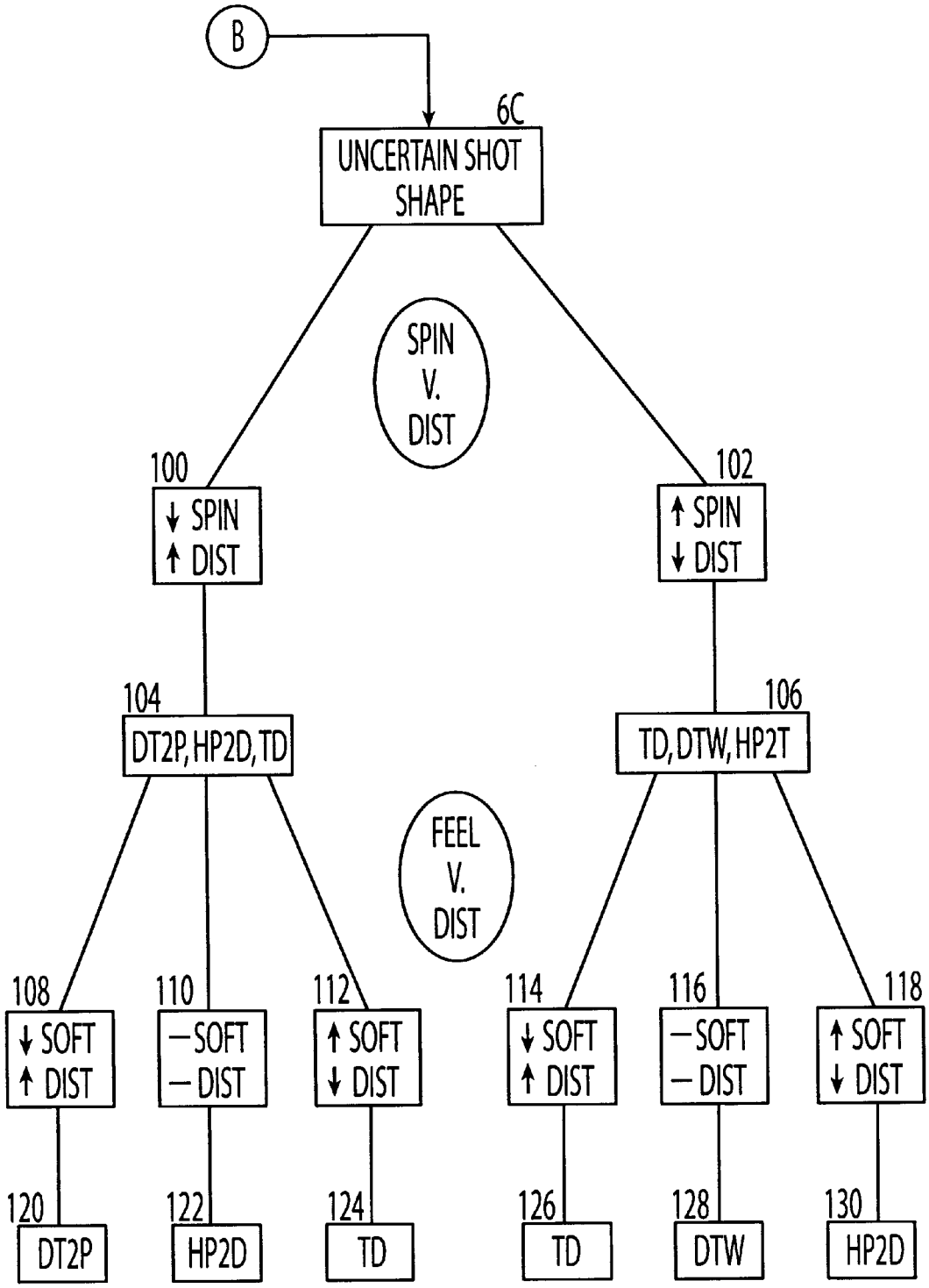
Figure 2D:
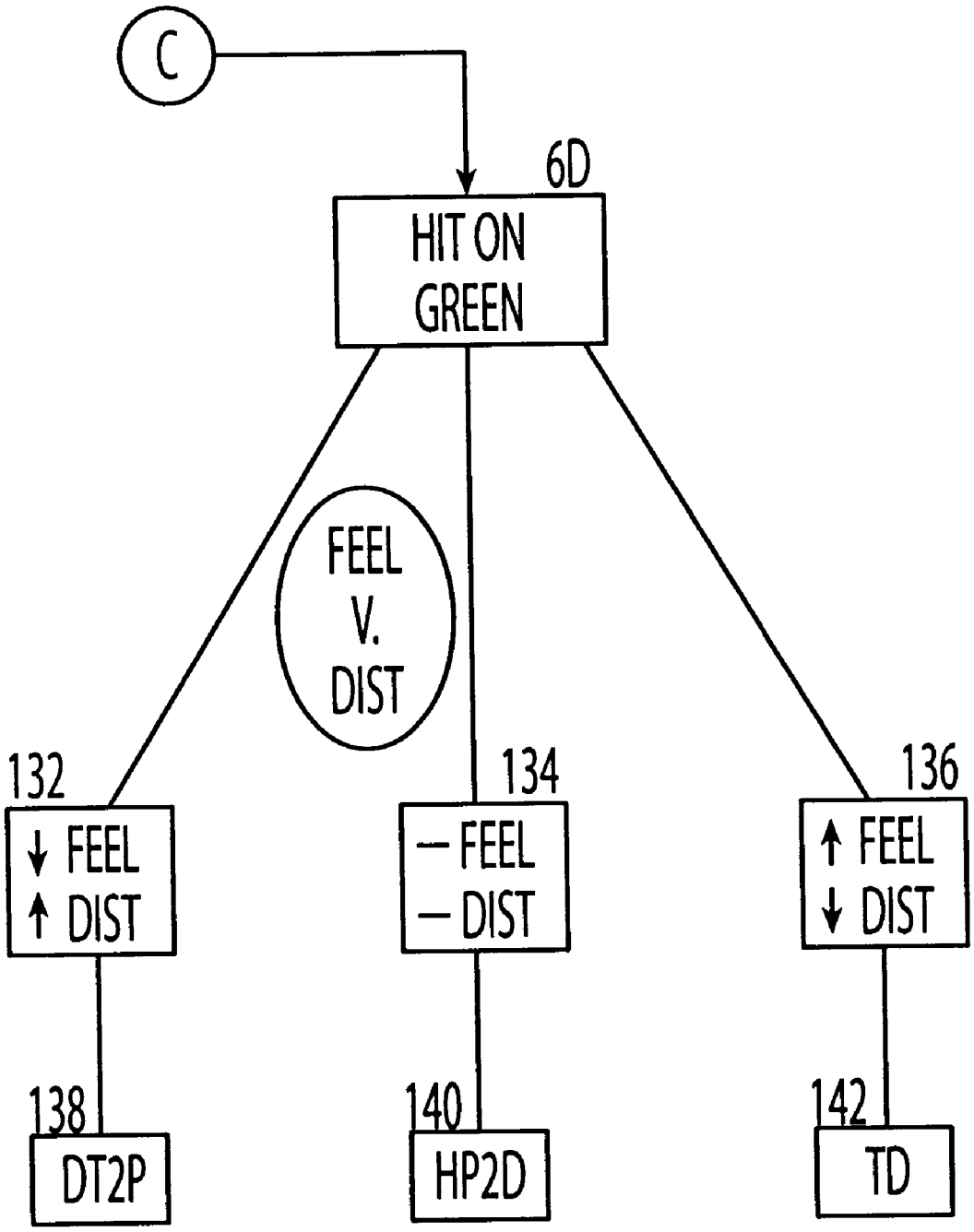

In the preferred first step, the golfer's average driving distance is determined by prompting the golfer to select or input their average drive distance l. The golfer may input or select their preferred responses by a plurality of means such as using a computer input device such as a mouse or a keyboard, a telephone touch pad, by tactile input through a computer monitor, or by voice recognition. Preferably, the golfer's input or selection is accomplished with a computer mouse. Most preferably, it is determined whether the golfer's average drive distance is greater than 200 yards or less than 200 yards. If the golfer indicates that the average driver distance is greater than 200 yards, at least one question is presented to further aid in defining the golfer's critical playing characteristics and, subsequently, the ideal golf ball performance characteristics. The questions may include, but are not limited to, determining which shot most affects the golfer's score on a typical par 4 golf hole. In response to this at least one question, a plurality of options are presented to the golfer that further aid in defining the golfer's critical playing characteristics. In another embodiment, the questions are based on the golfer's selection or input based on other delimiters, such as swing speed, rather than drive distance. Referring to the decision tree set forth in FIG. 1, a plurality of options presented to the golfer that are critical to their score on a typical golf hole may include, but are not limited to, the drive or tee shot 2, the second shot or the approach shot 146, or the third shot 256, which typically includes the short game and/or chipping and putting around the green.

If it is determined that the drive or tee shot 2 is the most critical shot to the determining the golfer's score on a typical par 4, a plurality of options are presented for the golfer's input or selection that aid in describing or determining the typical shape of that shot. The options may include, but are not limited to working the ball (purposely drawing or fading the golf ball) 4, a consistent shot shape on every tee shot 6, an uncertain or varied shot shape (unpredictably drawing or fading the ball) 8, and difficulty keeping the ball in play (hit the golf ball out of play and/or lose a lot of golf balls) 10 (See FIG. 2).

Depending on the golfer's selection or entry, a subset of a plurality of golf balls can be presented having characteristics that would benefit a player selecting a particular group as the most influential shot.

The terms "working the ball" or "shaping a shot" refer to the intentional variation in a golf swing creating, on demand, a particular orientation and magnitude of lift force. The term "consistent shot shape" refers to a golf swing producing the same orientation of lift force while the magnitude of lift force may vary. The term "uncertain shot shape" refers to a golf swing limiting the magnitude of lift force while the orientation may vary. The term "difficulty keeping the ball in play" refers to a golfer who is unable to control either the magnitude or the orientation of the lift force. The term "dead straight" refers to controlling both the orientation of the lift force and does not produce a push or pull angle. For the purposes of fitting a ball to a player, the "dead straight" shot is included as a subset of players having a "consistent shot shape".

The shape of a golf shot is determined by two things: the initial direction of the golf ball and the effect of the lift force on the golf ball. The initial direction is literally the path of the golf ball expressed as the combination of launch angle and push or pull angle. Generally speaking, the push or pull angle is not considered as the "shape" of the shot, which is observed after the initial direction is established. The lift force has a magnitude and an orientation. If sufficiently large, the lift force can alter the direction of flight. In a perfect scenario in which the golf ball is struck squarely and leaves the clubface with zero push or pull angle and the axis of rotation is parallel to the ground and perpendicular to the intended path, the lift force causes the golf ball to rise above its initial direction.

In a less than perfect scenario, a golf ball leaves the clubface with either a push or a pull angle and the axis of rotation is inclined. As a result of the inclined axis of rotation, the lift force is not oriented "straight up" but is directed slightly to the left or right. The lift force causes the golf ball to curve (deviate from its initial direction) according to the inclined axis of rotation. The magnitude of the lift force is controlled by the spin and speed of the ball. Hence, the orientation and magnitude of the lift force create the shot shape.

Tremendous variation exists within the world of the golfers with regard to launch conditions produced. Push or pull angle, inclination of axis of rotation, ball speed, and spin, all vary. For this reason, tremendous variation in shot shape can be observed among golfers. When asked about their usual shot shape, unless a golfer responds that they hit it dead straight every time (also a consistent shot shape), they will respond with one of the above mentioned shot shape types.

The spin of a golf ball is the rate of rotation about a single axis of rotation when hit by a club. The axis of rotation may or may not be aligned with the target. In a squarely struck golf ball, the axis of rotation is parallel to the ground and perpendicular to the target line. In this scenario, the golf ball is described as having little or no side spin and flies in a relatively straight line. When the golf ball is not struck squarely, the axis of rotation has another orientation; it is inclined. In this scenario, the lift force is not only directed upwards but is likewise inclined, causing the golf ball to be directed left or right. The more inclined the axis of rotation, the greater the direction away from the target line.

If working the ball (purposely shaping the shot as required by the hole) 4 is the selection or entry of the golfer, the parent group of golf balls is narrowed to at least one subset of golf balls having preferred characteristics for a golfer who works the ball. Because distance is typically of lesser importance for golfers who work the ball, the parent group preferably contains a plurality of golf balls having softer covers, more spin, and good "feel". The subset preferably has fewer golf balls than the parent group. The users preferred golf ball is determined from the subset by the golfer by selecting golf ball performance characteristics from a first group comprising spin and "feel" and a second group comprising durability and distance.

Preferably, a preferred golf ball matching the golfer's golf ball performance characteristics is selected from the first subset of golf balls by the golfer expressing a preference of golf ball spin versus golf ball durability. Additionally, a preferred golf ball matching the golfer's golf ball performance characteristics is selected from a group of golf balls having varying weights. Preferably, the golf ball weights are distinguished by those being greater than about 1.58 ounces and those less than about 1.58 ounces. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability. It has been determined that the opposite correlation of ball characteristics best determines a golfer's ball performance characteristics. As shown below, this step can be repeated several times with different opposing characteristics to determine that which is most critical to the golfer's game and ultimate score.

For example, players preferring a golf ball having low spin and high durability 12, a group of golf balls that is a first subset 16 of the parent group can be determined. The size of the first subset 16 is less than the size of the parent group and the golf balls have characteristics that satisfy the golfers spin and durability preference. For players preferring a high spin golf ball having lower durability 14, a group of golf balls that is a second subset 18 of the parent group can be suggested. Preferably, the second subset 18 contains golf balls having softer cover material than the golf balls of the first subset 16. The size of the second subset 18 is preferably less than the size of the parent group and the golf balls have characteristics that closely match the golfer's preferred spin characteristics determined by opposing and durability characteristics. The second subset 18 preferably does not contain the same golf balls as the first subset 16.

After determining the golfer's spin and durability preferences, either the first or second subset 18 is narrowed to a preferred golf ball or at least two subsets by determining the golfer's golf ball performance characteristics by further comparing spin versus distance. For example, players preferring a golf ball having low spin and increased distance, 20 or 24, a group of golf balls that is a third subset, 28 and 32, of the first or second subsets is determined. The size of the subsets should be less than the size of the first or second subsets, 16 and 18, and the golf balls have characteristics that further satisfy the golfer's ball performance characteristics through the comparison of opposite spin and distance characteristics. For example, players preferring a high spin golf ball at the cost of some distance, 22 or 26, a group of golf balls that is a subset, 30 or 34, of the first or second subsets is recommended. The subsets 28, 30, 32, and 34 preferably contains different golf balls. The size of the third subset is less than the size of the first and second subsets, 16 and 18, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 28, 30, 32, or 34 are further narrowed to at least two subsets by determining the golfer's ideal golf ball feel and distance characteristics. For example, players preferring less feel and greater distance, 36, 40, 44, or 48, a group of golf balls, 52, 56, 60, or 64, having at least one golf ball that is a subset of 28, 30, 32, or 34, is determined. The size of the subsets is less than the size of previous subsets and the golf balls have characteristics that are ideally matched to the golfer's spin and distance preference. For players preferring a golf ball having more feel and greater distance, 38, 42, 46 or 50, a group of golf balls 54, 58, 62, or 66, that is a subset of 28, 30, 32, or 34, is determined. The subsets 52–66 preferably does not contain different golf balls. The size of subsets 52–66 is preferably less than the size of parent subsets 28, 30, 32, or 34 and the golf balls have characteristics that ideally match the users feel and distance preferences as well as their spin and durability and spin and distance preferences.

In a preferred embodiment, the golfer makes the selection on a sliding scale, i.e., the golfer positions a marker on the 'feel' scale, which ranges from softer feel to firmer feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer enters or selects 'consistent shot shape' (purposely having the same shot shape) 6 to describe the typical shape of their tee shot, the parent group of golf balls having characteristics beneficial to the golfer having a consistent shot shape are determined. Because both distance and feel are of importance for golfers who have a consistent shot shape, the parent group preferably contains a plurality of golf balls having these as the primary characteristics. Preferably, at least one subset of golf balls, smaller than the parent group, is determined by the golfer expressing a preference of golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at some cost in spin, 68, a group of golf balls that is a first subset 72 of the parent group is determined. The size of the first subset 72 is less than the size of the parent group and the golf balls have characteristics that more closely match the golfer's golf ball spin and distance preference. For players preferring a golf ball that has higher spin at some cost in distance 70, a group of golf balls that is a second subset 74 of the parent group can be suggested. Preferably, the second subset 74 contains golf balls having softer cover material than the golf balls of the first subset 72. The size of the second subset 74 is preferably less than the size of the parent group and the golf balls have characteristics that closely match the golfer's spin and distance preference. The second subset 74 preferably does not contain the same golf balls as the first subset 72.

After determining the golf balls that ideally match the golfer's spin and distance preference, either the first or second subset, 72 or 74, is narrowed to at least two subsets by determining the golfer's preferred golf ball feel and distance characteristics. For example, players preferring a golf ball having increased distance but a harder feel, 76 or 82, a group of golf balls that is a subset, 88 or 94, of the first or second subsets, 72 or 74, is determined. The size of the subsets, 88 or 94, is less than the size of the first or second subsets, 72 and 74, and the golf balls have characteristics that further satisfy the golfer's desired feel and distance characteristics. For players preferring a golf ball having medium feel and distance characteristics, 78 or 84, a group of golf balls that is a subset, 90 or 96, of the first or second subsets, 72 or 74, is recommended. The size of the subsets is less than the size of the first or second subsets, 72 or 74, and the golf balls have characteristics that further match the golfer's preferred feel and distance characteristics. For players preferring a golf ball having softer feel at some cost in distance, 80 or 86, a group of golf balls that is a subset, 92 or 98, of the first or second subsets is determined. The size of the subsets is less than the size of the first or second subsets, 72 and 74, and the golf balls have characteristics that further satisfy the golfer's desired feel and distance characteristics. The subsets 88–98 preferably does not contain different golf balls. The size of the subsets is less than the size of the first and second subsets, 72 and 74, and the golf balls have characteristics that match both the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer enters or selects 'uncertain shot shape' (inconsistent or varied shot shape off the tee but only with minor variations in direction) 8 to describe the typical shape of their tee shot, the parent group of golf balls having characteristics beneficial to the golfer having an inconsistent shot shape are determined. Because low spin is of importance for golfers who have an inconsistent shot shape (to aid in lessening the effect of spin which causes a hook or slice), the parent group preferably contains a plurality of golf balls having lower spin.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having low spin and greater distance 100, a group of golf balls that is a first subset 104 of the parent group is determined. The size of the first subset 104 is less than the size of the parent group and the golf balls have characteristics that match the golfer's spin and distance characteristics. For players preferring a golf ball that has high spin at some cost in distance 102, a group of golf balls that is a second subset 106 of the parent group is determined. Preferably, the second subset 106 contains golf balls having softer cover material than the golf balls of the first subset 104. The size of the second subset 106 is preferably less than the size of the parent group and the golf balls have characteristics that closely match the golfer's spin and distance preference. The second subset 106 preferably does not contain the same golf balls as the first subset 104.

Subsequent to determining the golfer's spin and distance preference, either the first or second subset, 104 or 106, is narrowed to at least two subsets by determining the golfer's preferred feel and distance characteristics. For example, players preferring a golf ball having harder feel and increased distance, 108 or 114, a group of golf balls that is a subset, 120 or 126, of the first or second subsets is determined. The size of the subsets is less than the size of the first or second subsets, 104 or 106, and the golf balls have characteristics that further satisfy the golfer's desired feel and distance characteristics. For players preferring a golf ball having medium feel and distance, 110 or 116, a group of golf balls that is a subset, 122 or 128, of the first or second subsets is recommended. The size of the subsets is less than the size of the first or second subsets, 104 or 106, and the golf balls have characteristics that further satisfy the golfer's desired feel and distance characteristics. For players preferring a golf ball having softer feel and less distance, 112 or 128, a group of golf balls that is a subset, 124 or 130, of the first or second subsets is determined. The size of the subsets is less than the size of the first or second subsets, 104 or 106, and the golf balls have characteristics that further satisfy the golfer's desired feel and distance characteristics. The subsets 120–130 preferably does not contain different golf balls. The size of the subsets is less than the size of the first and second subsets, 104 or 106, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer enters or selects 'difficulty keeping the ball in play' (hit the golf ball out of play; major variations in direction) 10 to describe the typical shape of their tee shot, the parent group of golf balls having characteristics beneficial to the golfer having an inconsistent shot shape are determined. Because increased durability and distance, not high spin or soft feel, is of greater importance for golfers who have difficulty keeping the ball in play, the parent group preferably contains a plurality of golf balls having low spin and increased distance and durability.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having harder feel and increased distance, 134, a group of golf balls that is a subset, 140, of the first subset is determined. The size of the subset is less than the size of the first subset, 132, and the golf balls have characteristics that best match the golfer's desired golf ball feel and distance characteristics. For players preferring a golf ball having medium feel and distance, 136, a group of golf balls that is a subset, 142, of the first subset is recommended. The size of the subset is less than the size of the first subset, 132, and the golf balls have characteristics that best match the golfer's desired golf ball feel and distance characteristics. For players preferring a golf ball having softer feel but less distance, 138, a group of golf balls that is a subset, 144, of the first subset is determined. The size of the subset is less than the size of the first subset, 132, and the golf balls have characteristics that best match the golfer's desired golf ball feel and distance characteristics. The subsets, 140, 142, and 144, preferably does not contain different golf balls. The size of the subsets is less than the size of the parent subset and the golf balls have characteristics that match the golfer's feel and distance preferences.

Figure 3A:
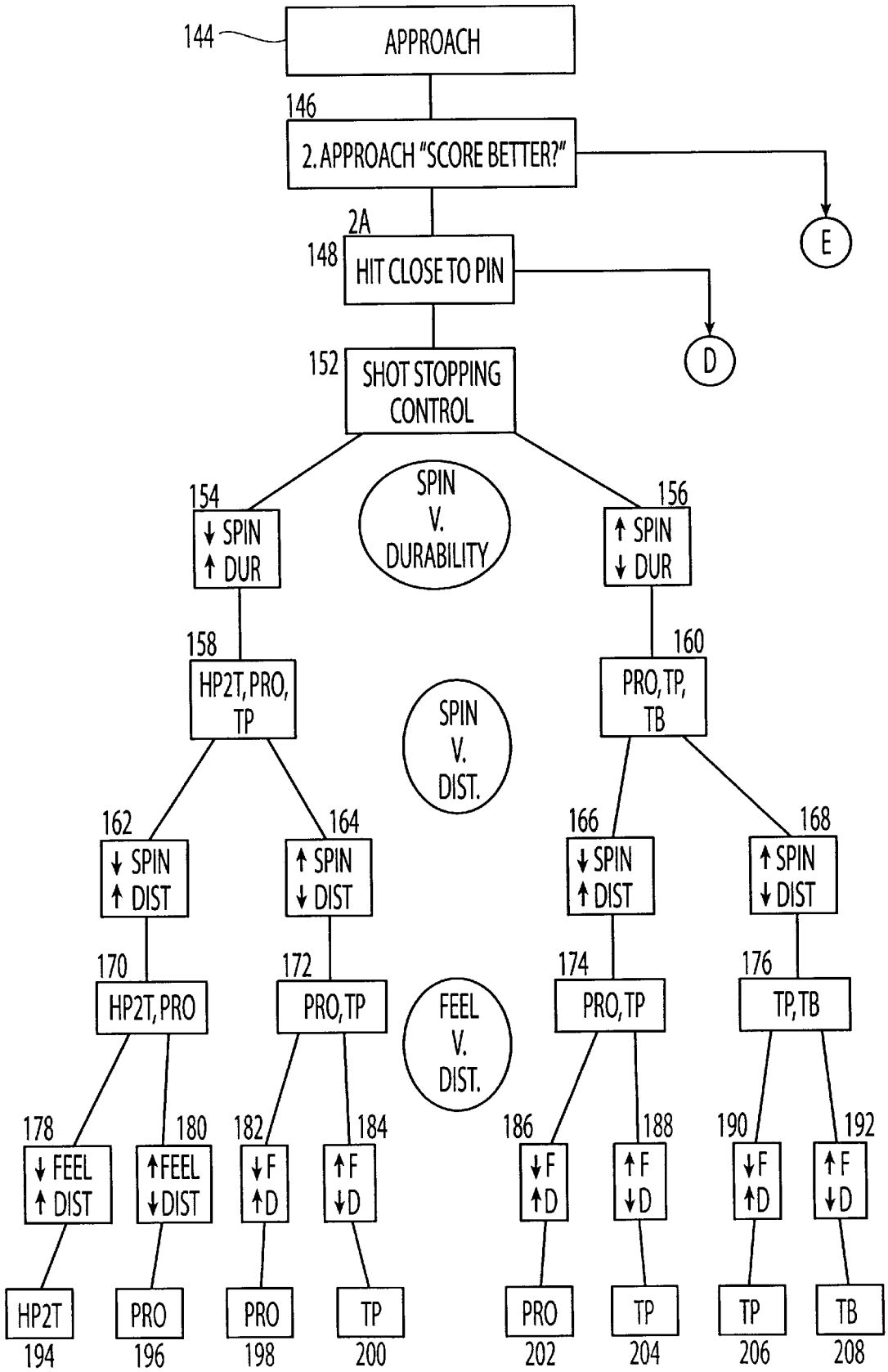
FIG. 3 is a decision tree depicting the second potential response of FIG. 1.
Figure 3B:
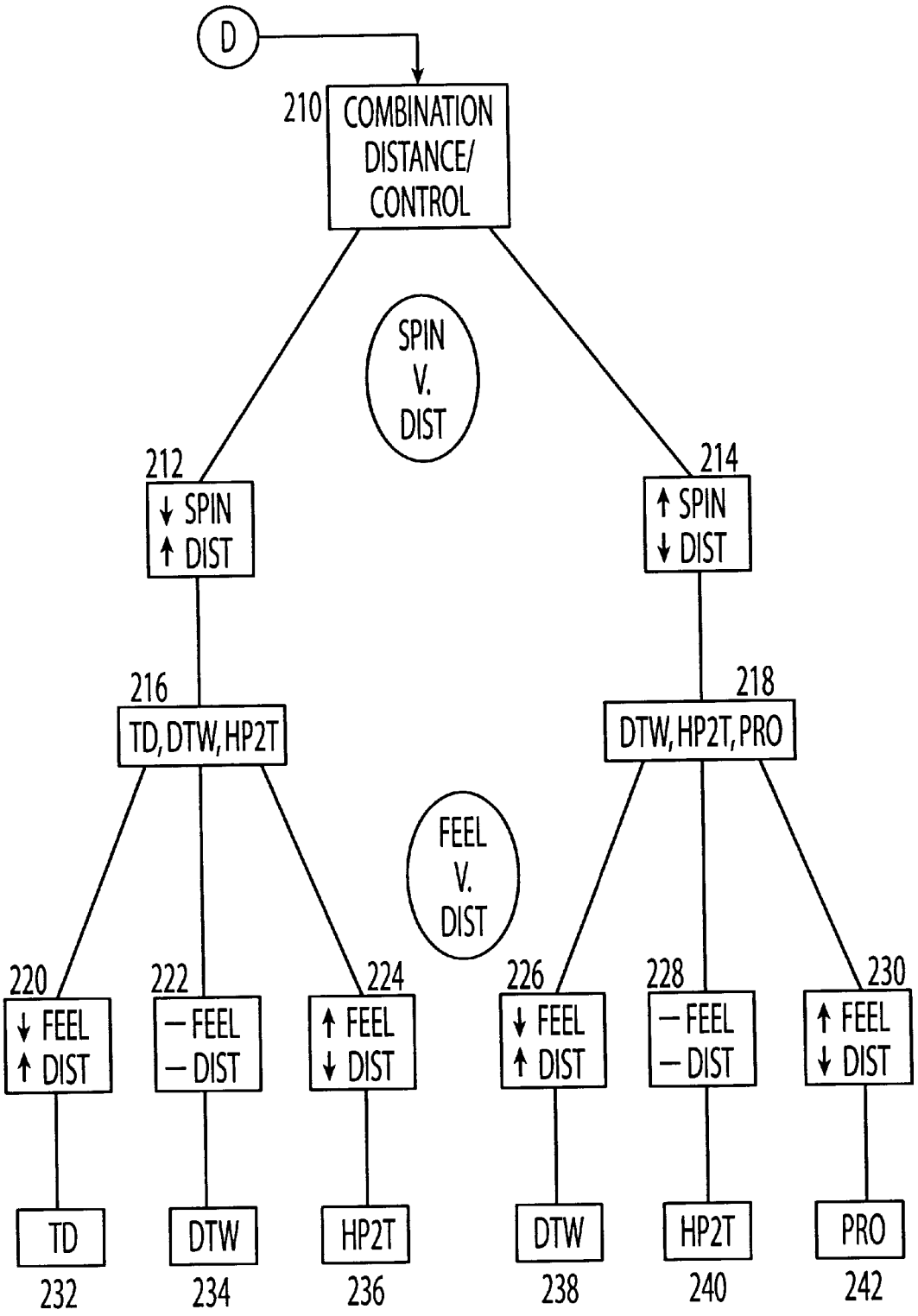
Figure 3C:
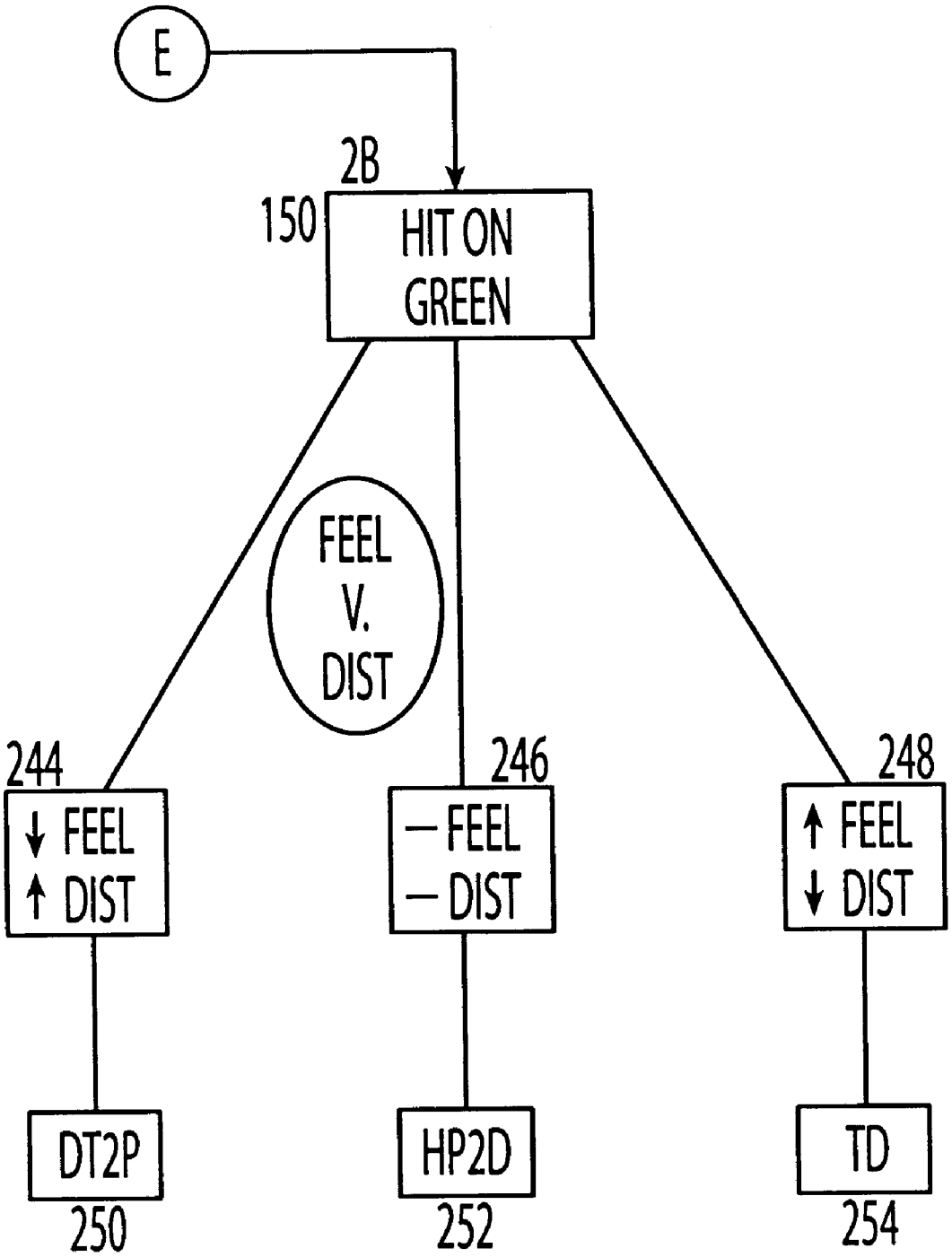

If it is determined that the approach or second shot 146 is the most critical shot to the determining the golfer's score on a typical par 4, a plurality of options are presented for the golfer's input or selection that aid in describing or determining the most ideal golf ball for the golfer (See FIG. 3). The options may include, but are not limited to a consideration of whether a successful approach shot is defined as hitting the golf ball close to the pin 148 or simply hitting the golf ball on the green 150.

If the golfer's critical playing characteristics result in hitting the golf ball close to the pin 148, a parent group of golf balls having characteristics that are beneficial for that type of shot are determined. The golfer may then be asked to select or input the preferred nature of a typical shot close to the pin: whether they prefer shot-stopping control 152 or a combination of distance and control 210. The parent group of golf balls is narrowed to at least one subset of golf balls having preferred characteristics for a golfer who is very precise with the approach shot and wants shot-stopping control 152. Because golf ball feel and spin are of greater importance than is distance for golfers who play target golf, the parent group preferably contains a plurality of golf balls having softer and good "feel". The subset preferably has fewer golf balls than the parent group. The at least one subset is determined by the golfer by selecting critical golf ball characteristics from a first group comprising spin and "feel" and a second group comprising durability and distance. Preferably, a first subset of golf balls is determined by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

For example, players preferring low spin and high durability 154, a group of golf balls that is a first subset 158 of the parent group is determined. The size of the first subset 158 is less than the size of the parent group and the golf balls have characteristics that satisfy the golfers spin and durability preference. For players preferring a golf ball having high spin at the cost of durability 56, a group of golf balls that is a second subset 160 of the parent group can be suggested. Preferably, the second subset 160 contains golf balls having softer cover material than the golf balls of the first subset 158. The size of the second subset 160 is preferably less than the size of the parent group and the golf balls have characteristics that closely match the golfer's spin/durability preference. The second subset 160 preferably does not contain the same golf balls as the first subset 158. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

After determining the golfer's spin and durability preferences, either the first or second subset, 158 or 160, is narrowed to at least two subsets by determining the golfer's golf ideal spin versus distance preference. For players preferring a golf ball having increased distance at the cost of golf ball spin, 162 or 166, a group of golf balls that is a subset, 170 or 174, of the first or second subsets is determined. The size of the subsets is less than the size of the first or second subsets 158 or 160, and the golf balls have characteristics that further satisfy the golfer's desired spin and distance characteristics. For players preferring a high spin golf ball at the expense of some distance, 164 or 168, a group of golf balls that is a subset, 172 or 176, of the first or second subsets is recommended. The subsets, 170, 172, 174, or 176, preferably does not contain different golf balls. The size of the subsets is less than the size of the first and second subsets, 158 or 160, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 170, 172, 174, or 176, are further narrowed to at least two subsets by determining the golfer's ideal value of "feel" versus distance. For example, players preferring greater distance at the cost of feel, 178, 182, 186, or 190, a group of golf balls, 194, 198, 202, or 206, having at least one golf ball that is a subset of 170, 172, 174, or 176 is determined. The size of the subsets is less than the size of previous subsets and the golf balls have characteristics that are ideally matched to the golfer's spin and distance preference. For players preferring a golf ball having more feel with less of a priority on distance, 180, 184, 188, 192, a group of golf balls 196, 200, 204, or 208, that is a subset of 170, 172, 174, or 176, is determined. The subsets 194–208 preferably does not contain different golf balls. The size of subsets 194–208 is preferably less than the size of subsets 170, 172, 174, or 176, and the golf balls have characteristics that ideally match the users feel and distance preferences as well as their spin and durability and spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If the golfer prefers hitting the golf ball close to the pin 148 and their critical playing characteristic is preferably a combination of distance and control 210, the parent group of golf balls is narrowed to at least one subset of golf balls having preferred characteristics for a golfer who prefers a combination of distance and control 210. Preferably, the golfer is asked to input or select their desired golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at the sacrifice of some spin 212, a group of golf balls that is a first subset 216, of a parent group of golf balls is determined. The size of the first subset 216 is less than the size of the parent group and the golf balls have characteristics that satisfy the golfer's spin and distance preference. For players preferring a golf ball that has high spin at the sacrifice of some distance 214, a group of golf balls that is a second subset 218 of the parent group can be suggested. Preferably, the second subset 218 contains golf balls having softer cover material than the golf balls of the first subset 216. The size of the second subset 218 is preferably less than the size of the parent group and the golf balls have characteristics that closely match the golfer's spin and distance preference. The second subset 218 preferably does not contain the same golf balls as the first subset 216.

After determining the golfer's spin and distance preference, either the first 216 or second 218 subset is narrowed to at least two subsets by determining the golfer's ideal feel versus distance preference. For example, players preferring a golf ball having increased distance while foregoing some feel, 220 or 226, a group of golf balls that is a subset, 232 or 238, of the first or second subsets is determined. The size of the subsets is less than the size of the first or second subsets, 216 or 218, and the golf balls have characteristics that further satisfy the golfer's desired feel and distance characteristics. For players preferring a golf ball having medium feel and distance, 222 or 228, a group of golf balls that is a subset, 234 or 240, of the first or second subsets is recommended. The size of the subsets is less than the size of the first or second subsets, 216 or 218, and the golf balls have characteristics that further satisfy the golfer's desired feel and distance characteristics. For players preferring a golf ball having softer feel at the expense of some distance, 224 or 230, a group of golf balls that is a subset, 236 or 242, of the first or second subsets is determined. The size of the subsets is less than the size of the first or second subsets, 216 or 218, and the golf balls have characteristics that further satisfy the golfer's desired feel and distance characteristics. The subsets 232–242 preferably does not contain different golf balls. The size of the subsets is less than the size of the first and second subsets, 216 or 218, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If it is determined that the approach or second shot 146 is the most critical shot to the determining the golfer's score on a typical par 4, a plurality of options are presented for the golfer's input or selection that aid in describing or determining the most ideal golf ball for the golfer. The golfer is preferably asked to input or select what typically makes them score better. The options may include, but are not limited to hitting the golf ball close to the pin 148 or aiming and hitting the golf ball on the green 150. If the golfer inputs or selects hitting the ball on the green 150, the golfer is queried as to the preferred characteristics of golf ball feel versus distance.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having increased distance at the expense of feel, 244, a group of golf balls that is a subset, 250, of the first subset is determined. The size of the subset is less than the size of the parent group and the golf balls have characteristics that further satisfy the golfer's desired feel and distance characteristics. For players preferring a golf ball having medium feel and distance, 246, a group of golf balls that is a subset, 252, of the first subset is recommended. The size of the subsets is less than the size of the parent group and the golf balls have characteristics that further satisfy the golfer's desired feel and distance characteristics. For players preferring a golf ball having softer feel with less distance, 248, a group of golf balls that is a subset, 254, of the first subset is determined. The size of the subsets is less than the size of the parent group and the golf balls have characteristics that further satisfy the golfer's desired feel and distance characteristics. The subsets, 250, 252, and 254, preferably does not contain different golf balls.

If it is determined that the third shot (chipping and pitching the golf ball near the green; the short game ability) 256 is the most critical shot to the determining the golfer's score on a typical par 4, a plurality of options are presented for the golfer's input or selection that aid in describing or determining the most ideal golf ball for the golfer. The options may include, but are not limited to whether they prefer shot-stopping control 258 or a combination of distance and control 260. The parent group of golf balls is narrowed to at least one subset of golf balls having preferred characteristics for a golfer who is very precise with the approach shot and wants shot-stopping control. Because golf ball feel and spin are of greater importance than is distance for golfers whose scores are most affected by the short game ability, chipping and putting, the parent group preferably contains a plurality of golf balls having softer "feel" and therefore, more spin. At least one subset is determined by the golfer by selecting preferred golf ball characteristics from a first group comprising spin and "feel" and a second group comprising durability and distance. Preferably, a first subset of golf balls is determined by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

For example, players preferring a low spin ball and high durability 262, a group of golf balls that is a first subset, 266, of the parent group is determined. The size of the first subset 266 is less than the size of the parent group and the golf balls have characteristics that satisfy the golfers spin and durability preference. For players preferring a golf ball having high spin at some cost in durability 264, a group of golf balls that is a second subset 268 of the parent group can be suggested. Preferably, the second subset 268 contains golf balls having softer cover material than the golf balls of the first subset 266. The size of the second subset 268 is preferably less than the size of the parent group and the golf balls have characteristics that closely match the golfer's spin and durability preference. The second subset 268 preferably does not contain the same golf balls as the first subset 266. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability.

After determining the golfer's spin and durability preferences, either the first or second subset, 266 or 268, is narrowed to at least two subsets by determining the golfer's ideal golf ball spin and distance characteristics. For example, players preferring a golf ball having increased distance at the cost of golf ball spin, 270 or 274, a group of golf balls that is a subset, 278 or 282, of the first or second subsets is determined. The size of the subsets is less than the size of the first or second subsets, 266 or 268, and the golf balls have characteristics that further satisfy the golfer's desired spin and distance characteristics. For players preferring a high spin golf ball at the expense of some distance, 272 or 276, a group of golf balls that is a subset, 280 or 284, of the first or second subsets is recommended. The subsets, 278, 280, 282, or 284, preferably does not contain different golf balls. The golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 278, 280, 282, or 284, are further narrowed to at least two subsets by determining the golfer's ideal golf ball feel and distance characteristics. For example, players preferring greater distance at the cost of feel, 286, 290, 294, or 298, a group of golf balls, 302, 306, 310, or 314, having at least one golfball that is a subset of 278, 280, 282, or 284 is determined. The size of the subsets is less than the size of previous subsets and the golf balls have characteristics that are ideally matched to the golfer's spin and distance preference. For players preferring a golf ball having more feel with less of a priority on distance, 288, 292, 296, or 300, a group of golfballs 304, 308, 312, or 316, that is a subset of 278, 280, 282, or 284, is determined. The subsets 302–316 preferably does not contain different golf balls. The size of subsets 302–316 is preferably less than the size of subsets 278, 280, 282, or 284, and the golf balls have characteristics that ideally match the users feel and distance preferences as well as their spin and durability and spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 4A:
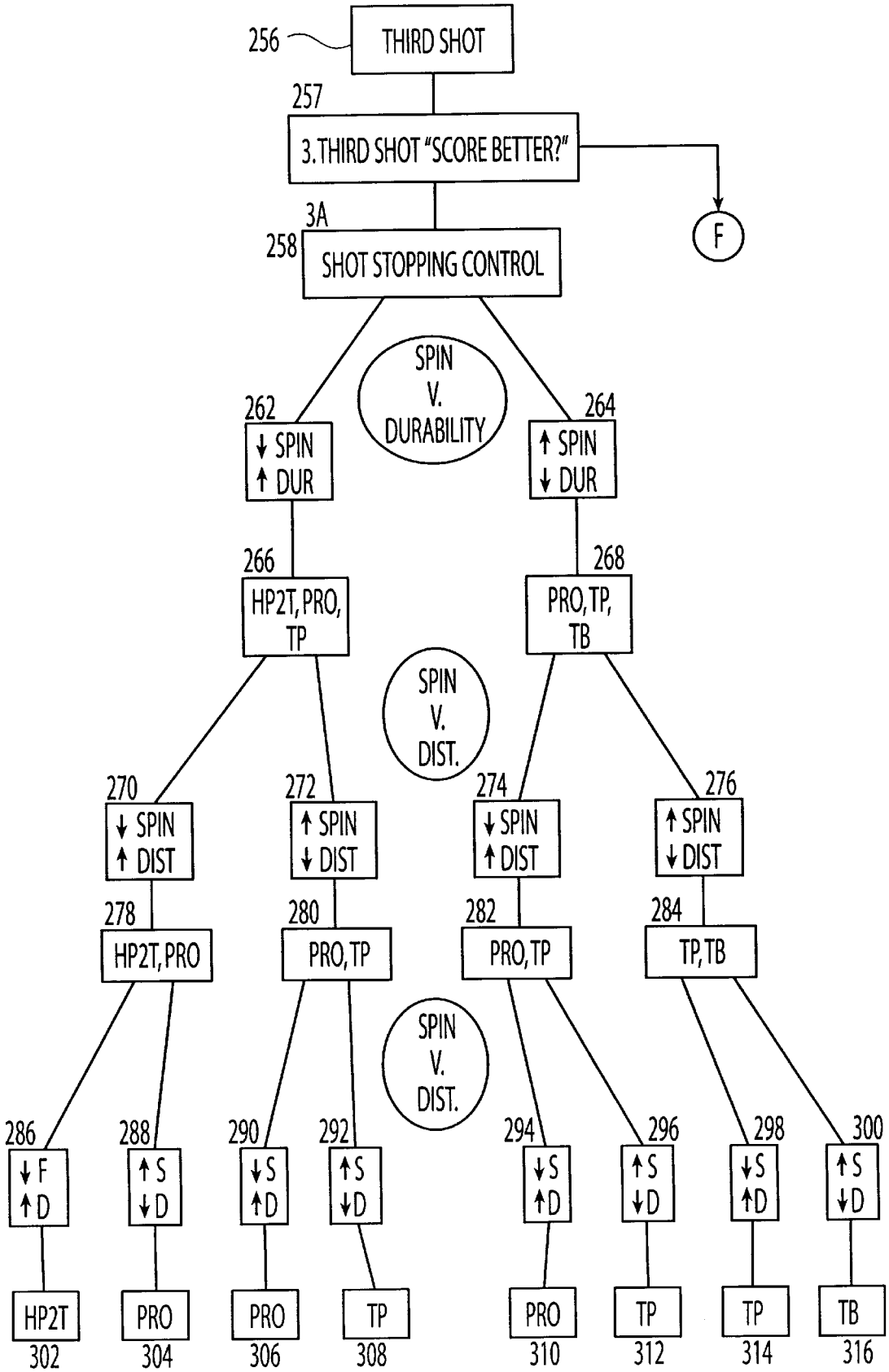
FIG. 4 is a decision tree depicting the third potential response from FIG. 1.
Figure 4B:
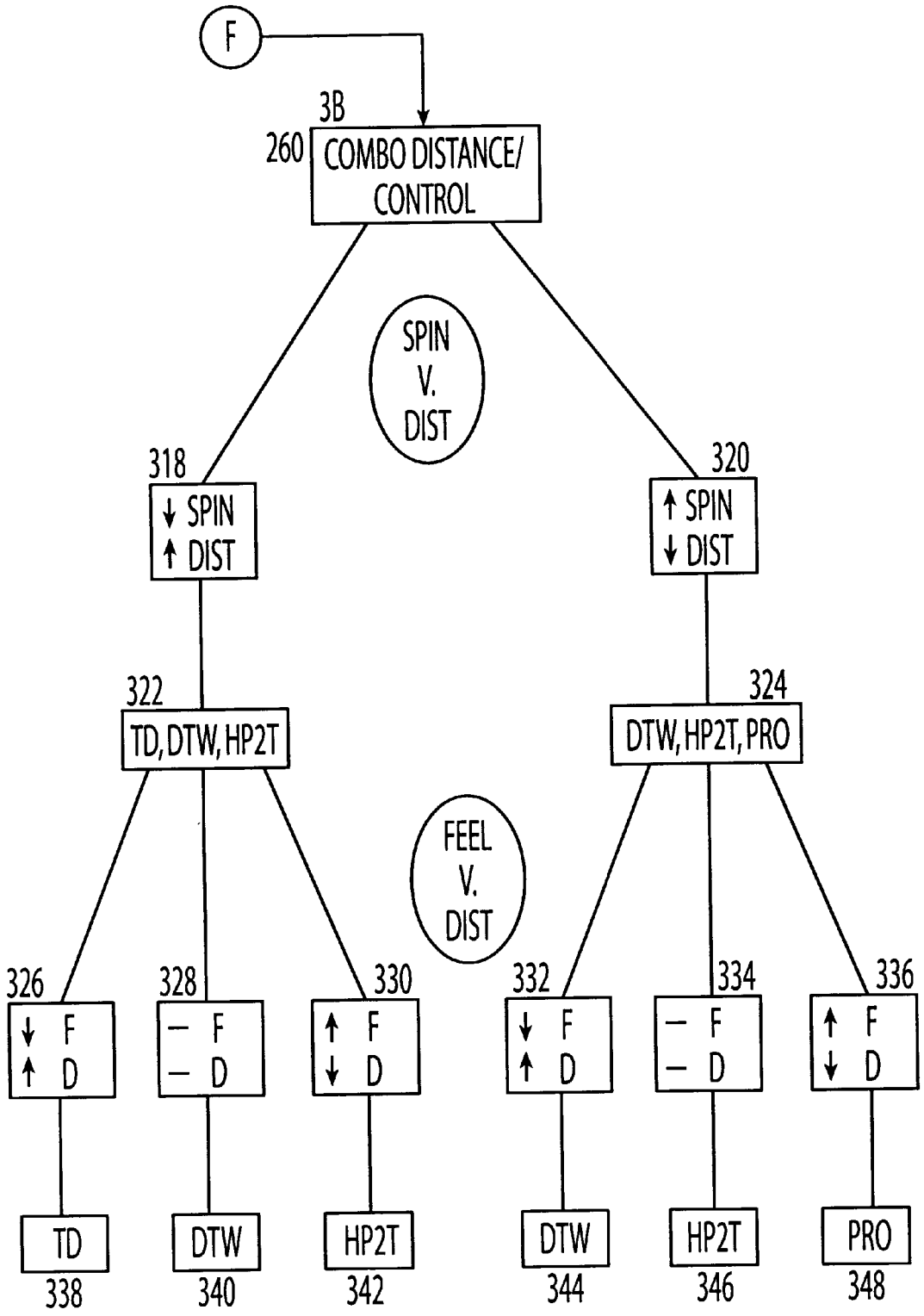

If it is determined that the third shot (chipping and pitching the golf ball near the green; the short game ability) 256 is the most critical shot to the determining the golfer's score on a typical par 4, a plurality of options are presented for the golfer's input or selection that aid in describing or determining the most ideal golf ball for the golfer (See FIG. 4). The options may include, but are not limited to whether they prefer shot-stopping control 258 or a combination of distance and control 260. If the golfer prefers a combination of distance and control 260, a parent group of golf balls having characteristics that are beneficial for that type of shot are determined. Preferably, the golfer is asked to input or select their desired golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at the sacrifice of some spin 318, a group of golf balls that is a first subset 322, of a parent group of golf balls is determined. The size of the first subset 322 is less than the size of the parent group and the golf balls have characteristics that satisfy the golfer's spin and distance preference. For players preferring a golf ball that has high spin at the sacrifice of some distance 320, a group of golf balls that is a second subset 324 of the parent group can be suggested. Preferably, the second subset 324 contains golf balls having softer cover material than the golf balls of the first subset 322 The size of the second subset 324 is preferably less than the size of the parent group and the golf balls have characteristics that closely match the golfer's spin and distance preference. The second subset 324 preferably does not contain the same golf balls as the first subset 322.

After determining the golfer's spin and distance preference, either the first 322 or second 324 subset is narrowed to at least two subsets by determining the golfer's ideal golf ball feel and distance characteristics. For example, players preferring a golf ball having increased distance while foregoing some feel, 326 or 332, a group of golf balls that is a subset, 338 or 344, of the first or second subsets can be determined. The size of the subsets is less than the size of the first or second subsets, 322 or 324, and the golf balls have characteristics that further satisfy the golfer's desired feel and distance characteristics. For players preferring a golf ball having medium feel and distance, 328 or 334, a group of golf balls that is a subset, 340 or 346, of the first or second subsets is recommended. The size of the subsets is less than the size of the first or second subsets, 322 or 324, and the golf balls have characteristics that further satisfy the golfer's desired feel and distance characteristics. For players preferring a golf ball having softer feel at the expense of some distance, 330 or 336, a group of golf balls that is a subset, 342 or 348, of the first or second subsets can be determined. The size of the subsets is less than the size of the first or second subsets, 322 or 324, and the golf balls have characteristics that further satisfy the golfer's desired feel and distance characteristics. The subsets 338–348 preferably does not contain different golf balls. The size of the subsets is less than the size of the first and second subsets, 322 or 324, and the golf balls have characteristics that further match the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic can be determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 5A:
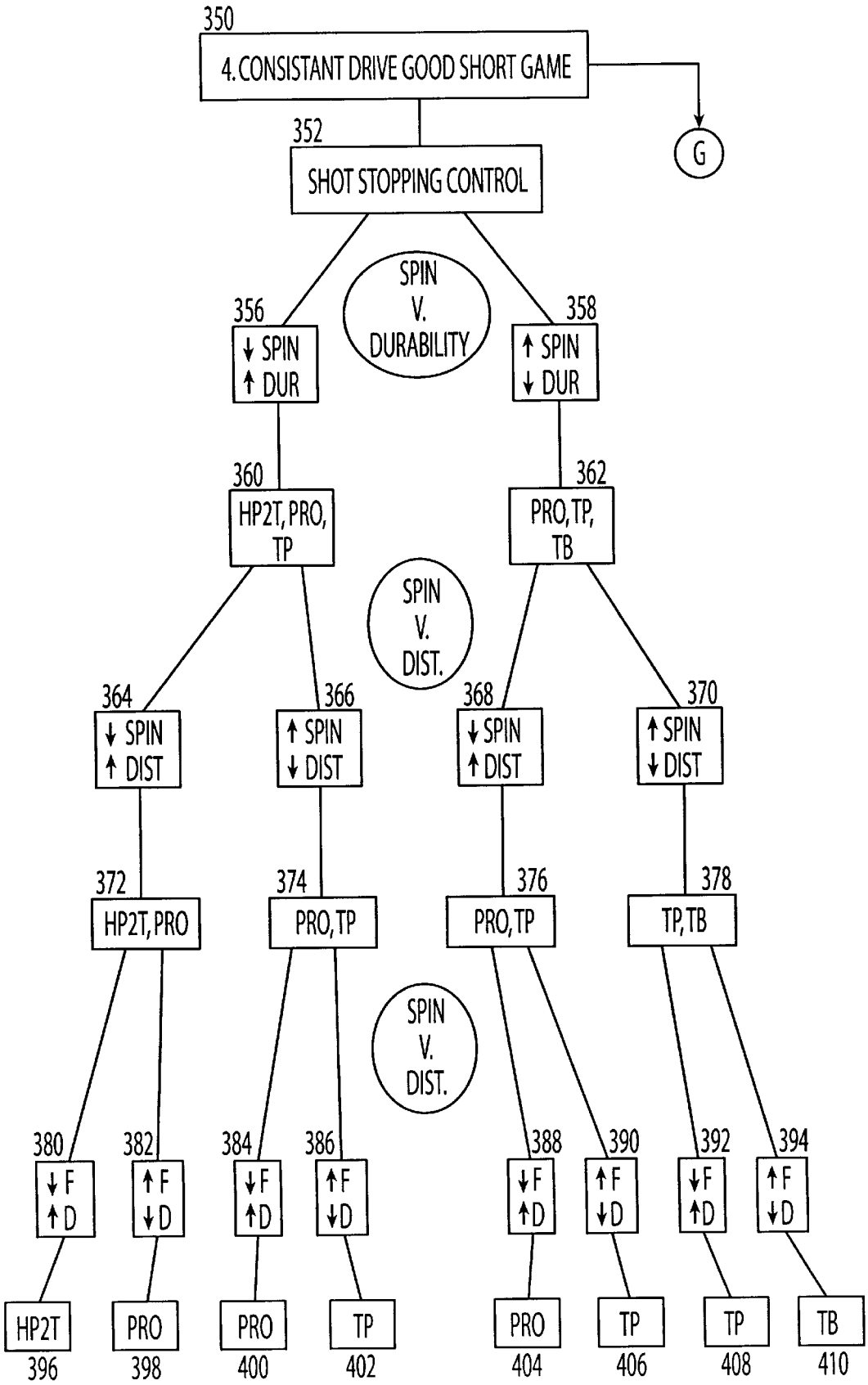
FIG. 5 is a decision tree depicting the fourth potential response from FIG. 1.
Figure 5B:
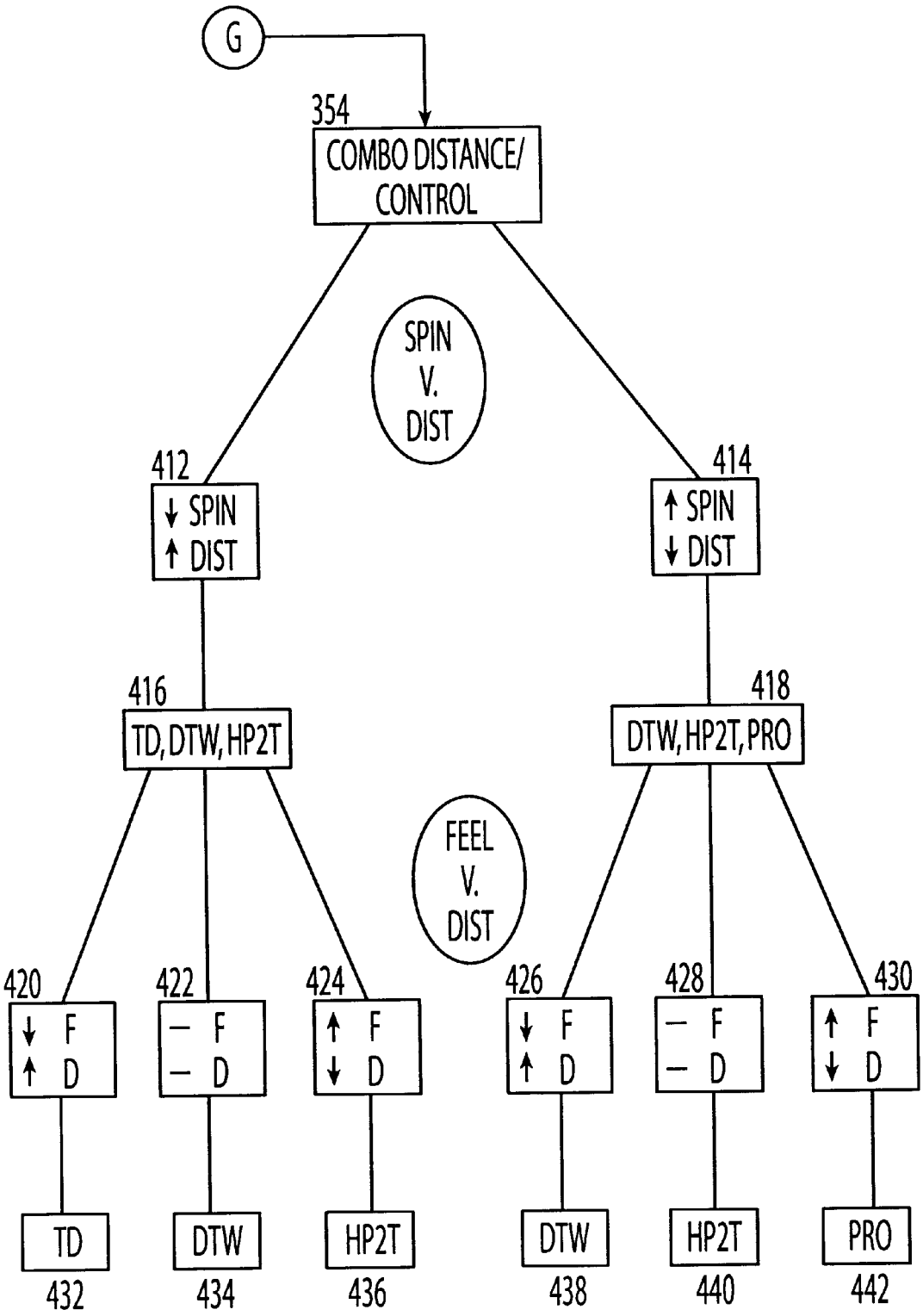

If the golfer indicates that the average driver distance is less than 200 yards, at least one question is presented to further aid in defining the golfer's critical playing characteristics and, subsequently, the ideal golf ball and ball characteristics. The questions may include, but are not limited to, determining which description most closely describes the golfer's type of play. In response to this at least one question, a plurality of options are presented to the golfer that further aid in defining the golfer's critical playing characteristics. Referring to the decision tree set forth in FIG. 5, a plurality of options presented to the golfer that describe their style of play may include, but are not limited to, having a consistent drive along with a good short game ability 350 and being an emerging or challenged player 444.

If it is determined that having a consistent drive along with a good short game ability 350 best describes the golfer's style of play, a plurality of options are presented for the golfer's input or selection that aid in describing or determining which shot, on approach shots, is most likely to help the golfer score better. The options may include, but are not limited to having shot-stopping control 352 and having a combination of distance and control 354. Depending on the golfer's selection or entry, a subset of a plurality of golf balls can be presented having characteristics that would benefit a player selecting a particular group as the most influential shot.

If having shot-stopping control 352 is the selection or entry of the golfer, the parent group of golf balls is narrowed to at least one subset of golf balls having preferred characteristics for a golfer who works the ball. Because distance is of lesser importance for golfers who prefer shot-stopping control, the parent group preferably contains a plurality of golf balls having softer covers, more spin, and good "feel". The subset preferably has fewer golf balls than the parent group. The users preferred golf ball is determined from the subset by the golfer by selecting critical golf ball characteristics from a first group comprising spin and "feel" and a second group comprising durability and distance. Preferably, a preferred golf ball matching the golfer's critical golf ball characteristics is selected from the first subset of golf balls by the golfer expressing a preference of golf ball spin versus golf ball durability. In a preferred embodiment, the golfer makes the selection on a sliding scale, i.e., the golfer positions a marker on the 'spin' scale, ranging from low spin to high spin, at the level of spin that said golfer considers ideal. Within a particular subset of golf balls, durability is related to spin in an opposite manner and is concurrently adjusted on its scale to reflect this property. The golfer positions a marker along a bar representing 'spin' at a desired value (normalized to a value of 0–1). A marker representing 'durability' automatically and concurrently slides to a position on a similar bar representing a value of 1 minus the spin value. The golfer's ideal spin versus durability setting may also be determined by positioning the durability marker which will concurrently slide the spin marker in opposite correlation to the durability. It has been determined that the opposite correlation of ball characteristics best determines a golfer's ball performance characteristics. As shown below, this step can be repeated several times with different opposing characteristics to determine that which is most critical to the golfer's game and ultimate score.

For example, players preferring low spin and high durability 356, a group of golf balls that is a first subset 360 of the parent group can be determined. The size of the first subset 360 is less than the size of the parent group and the golf balls have characteristics that satisfy the golfers spin and durability preference. For players preferring a high spin golf ball having lower durability 358, a group of golf balls that is a second subset 362 of the parent group can be suggested. Preferably, the second subset 362 contains golf balls having softer cover material than the golf balls of the first subset 360 The size of the second subset 362 is preferably less than the size of the parent group and the golf balls have characteristics that closely match the golfer's spin critical characteristics determined by opposing and durability characteristics. The second subset 362 preferably does not contain the same golf balls as the first subset 360.

After determining the golfer's spin and durability preferences, either the first or second subset, 360 or 362, is narrowed to a preferred golf ball or at least two subsets by determining the golfer's critical golf ball characteristics by further comparing spin versus distance preferences. For example, players preferring a golf ball having low spin and increased distance, 364 or 368, a group of golf balls that is a third subset, 372 or 376, of the first or second subsets is determined. The size of the subsets should be less than the size of the first or second subsets, 360 or 362, and the golf balls have characteristics that further satisfy the golfer's ball performance characteristics through the comparison of opposite spin and distance characteristics. For example, players preferring a high spin golf ball at the cost of some distance, 366 or 370, a group of golf balls that is a subset, 374 or 378, of the first or second subsets is recommended. The subsets 372, 374, 376, or 378 preferably contain different golf balls. The size of the third subset is less than the size of the first and second subsets, 360 or 362, and the golf balls have characteristics that further match the golfer's spin and distance preferences, as well as their spin and durability preferences.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

Depending on the golfer's selection or input regarding their spin and distance preferences, subsets 372, 374, 376, or 378 are further narrowed to at least two subsets by determining the golfer's ideal golf ball feel and distance characteristics. For example, players preferring less feel and greater distance, 380, 384, 388, or 392, a group of golf balls, 396, 400, 404, or 408, having at least one golf ball that is a subset of 372, 374, 376, or 378, is determined. The size of the subsets is less than the size of previous subsets and the golf balls have characteristics that are ideally matched to the golfer's spin and distance preference. For players preferring a golf ball having more feel and greater distance, 382, 386, 390, or 394, a group of golf balls 398, 402, 406, or 410, that is a subset of 372, 374, 376, or 378, is determined. The subsets 396–410 preferably do not contain different golf balls. The size of subsets 396–410 is preferably less than the size of parent subsets 372, 374, 376, or 378 and the golf balls have characteristics that ideally match the users feel and distance preferences as well as their spin and durability and spin and distance preferences.

In a preferred embodiment, the golfer makes the selection on a sliding scale, i.e., the golfer positions a marker on the 'feel' scale, which ranges from softer feel to firmer feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

If having a combination of distance and control 354 is the selection of the golfer, a parent group of golf balls having said characteristics is determined. Because both distance and feel are of importance for golfers who desire a combination of distance and control, the parent group preferably contains a plurality of golf balls having these as the primary characteristics. Preferably, at least one subset of golf balls, smaller than the parent group, is determined by the golfer expressing a preference of golf ball spin and distance characteristics.

In a preferred embodiment, the golfer selects the desired spin and distance characteristics on a sliding scale, i.e., the golfer positions a marker on the 'spin' scale, which ranges from low spin to high spin, at the level of spin that said golfer considers ideal. Within a particular subset of golf balls, distance is related to spin in an opposite manner and is concurrently adjusted on its scale to reflect this property. More preferably, the desired golf ball performance characteristic is determined by having the golfer position a marker along a scale bar representing 'spin' at a desired value (normalized to a value of 0–1). A marker representing 'distance' automatically and concurrently slides to a position on a similar bar representing a value of 1 minus spin value in opposite correlation to the spin selection. The golfer's ideal spin versus distance setting may also be determined by positioning the distance marker, concurrently sliding the spin marker in opposite correlation to the distance selection.

For example, players preferring golf balls having greater distance at some cost in spin, 412, a group of golf balls that is a first subset 416 of the parent group is determined. The size of the first subset 416 is less than the size of the parent group and the golf balls have characteristics that more closely match the golfer's golf ball spin and distance preference. For players preferring a golf ball that has higher spin at some cost in distance 414, a group of golf balls that is a second subset 418 of the parent group can be suggested. Preferably, the second subset 418 contains golf balls having softer cover material than the golf balls of the first subset 416. The size of the second subset 418 is preferably less than the size of the parent group and the golf balls have characteristics that closely match the golfer's spin and distance preference. The second subset 418 preferably does not contain the same golf balls as the first subset 416.

After determining the golf balls that ideally match the golfer's spin and distance preference, either the first or second subset, 416 or 418, is narrowed to at least two subsets by determining the golfer's preferred golf ball feel and distance characteristics. For example, players preferring a golf ball having increased distance but a harder feel, 420 or 426, a group of golf balls that is a subset, 432 or 438, of the first or second subsets, 416 or 418, is determined. The size of the subsets, 432 or 438, is less than the size of the first or second subsets, 416 or 418, and the golf balls have characteristics that further satisfy the golfer's desired feel and distance characteristics. For players preferring a golf ball having medium feel and distance characteristics, 422 or 428, a group of golf balls that is a subset, 434 or 440, of the first or second subsets, 416 or 418, is recommended. The size of the subsets is less than the size of the first or second subsets, 416 or 418, and the golf balls have characteristics that further satisfy the golfer's critical golf ball feel and distance characteristics. For players preferring a golf ball having softer feel at some cost in distance, 424 or 430, a group of golf balls that is a subset, 436 or 442, of the first or second subsets is determined. The size of the subsets is less than the size of the first or second subsets, 416 or 418, and the golf balls have characteristics that further satisfy the golfer's desired feel and distance characteristics. The subsets 432–442 preferably does not contain different golf balls. The size of the subsets is less than the size of the first and second subsets, 416 or 418, and the golf balls have characteristics that match both the golfer's feel and distance preferences, as well as their spin and distance preferences.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

Figure 6:
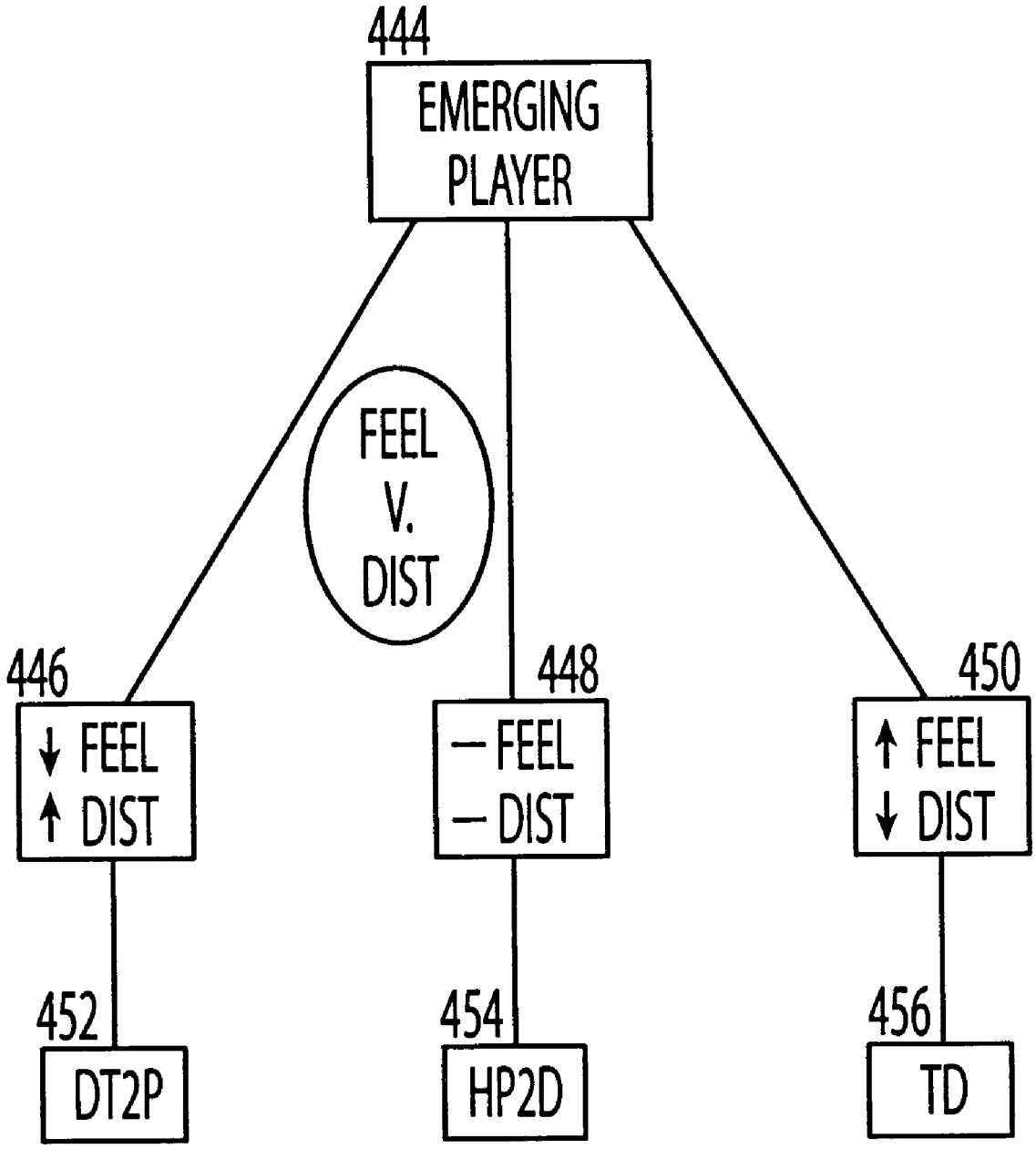
FIG. 6 is a decision tree depicting the fifth potential response from FIG. 1.

If the golfer enters or selects 'emerging or challenged player' 444 to describe their type or style of play, the parent group of golf balls having characteristics beneficial to the golfer having said style is determined (See FIG. 6). Because increased durability and distance, not high spin or soft feel, is of greater importance for golfers who are challenged or are learning the game of golf, the parent group preferably contains a plurality of golf balls having low spin and increased distance and durability.

In a preferred embodiment, the golfer selects the desired feel and distance characteristics on a sliding scale, i.e., the golfer positions a marker on the 'feel' scale, which ranges from soft feel to firm feel, at the level of feel that said golfer considers ideal. Within a particular subset of golf balls, distance is related to feel in an opposite manner and is concurrently adjusted on its scale to reflect this property. More preferably, the desired golf ball performance characteristic is determined by having the golfer position a marker along a scale bar representing 'feel' at a desired value (normalized to a value of 0–1). A marker representing 'distance' automatically and concurrently slides to a position on a similar bar representing a value of 1 minus the feel value in opposite correlation to the feel selection. The golfer's ideal feel versus distance setting may also be determined by positioning the distance marker, concurrently sliding the feel marker in opposite correlation to the distance selection.

For example, players preferring a golf ball having harder feel and increased distance, 446, a group of golf balls that is a subset, 452, of the parent group is determined. The size of the subset is less than the size of the parent group and the golf balls have characteristics that best match the golfer's desired golf ball feel and distance characteristics. For players preferring a golf ball having medium feel and distance, 448, a group of golf balls that is a subset, 454, of the parent group is recommended. The size of the subset is less than the size of the parent group and the golf balls have characteristics that best match the golfer's desired golf ball feel and distance characteristics. For players preferring a golf ball having softer feel but less distance, 450, a group of golf balls that is a subset, 456, of the parent group is determined. The size of the subset is less than the size of the parent group and the golf balls have characteristics that best match the golfer's desired golf ball feel and distance characteristics. The subsets, 452, 454, or 456, preferably do not contain different golf balls. The size of the subsets is less than the size of the parent subset and the golf balls have characteristics that match the golfer's feel and distance preferences.

As is readily apparent to one skilled in the art, adaptations of the above methodology are possible without departing from the intention of the invention, which is defined in the appended claims.

What is claimed:

1. A method for selecting a golf ball from a predetermined set of golf balls comprising the steps of:

a) determining a golfer's critical playing characteristics through an interactive process;

b) prioritizing ball performance characteristics through a second interactive process taking into account the golfer's critical playing characteristics; and c) selecting a golf ball from the set of golf balls which best matches the golfer's critical playing characteristics for the purpose of reducing the golfer's score.

2. The method of claim 1, wherein the step of determining the golfer's critical playing characteristics comprises using an algorithm having a plurality of interactive questions.

3. The method of claim 2, wherein the golfer's critical playing characteristics are determined from a plurality of playing characteristics including one or more of the following: shot distance for a predetermined club, shot shape, shot accuracy, shot consistency, aid short game ability.

4. The method of claim 1, wherein the step of prioritizing the ball performance characteristics comprises an interactive process, taking into account tile golfer's critical playing characteristics, of evaluating the opposing ball characteristics.

5. The method of claim 4, wherein the opposing ball performance characteristics comprise one or more of the following: distance, spin, durability, and feel.

6. The method of claim 5, wherein the step of evaluating the opposing ball performance characteristics includes comparing at least one of a first group of characteristics comprising spin and feel versus at least one of a second group of characteristics comprising durability and distance to determine the ball performance characteristics.

7. The method of claim 3, wherein the golfer is identified as having a typical shot shape selected from the following:

a) golfers who work the ball;

b) golfers with a consistent shot shape;

c) golfers with an uncertain shot shape; and d) players having difficulty keeping the ball in play due to an uncertain shot shape.

8. The method of claim 6, wherein a ball performance characteristic is selected by the golfer expressing a preference of golf ball spin versus golf ball durability.

9. The method of claim 6, wherein a golf ball performance characteristic is selected by the golfer expressing a preference of golf ball spin versus golf ball distance.

10. The method of claim 6, wherein a ball performance characteristic is selected by the golfer expressing a preference of golf ball feel versus golf ball distance.

11. The method of claim 3, wherein the golfer's critical playing characteristic of shot accuracy is evaluated by considering one or more of a drive or an approach shot.

12. The method of claim 11, wherein the golfer's critical playing characteristic of shot accuracy is evaluated by considering whether a successful approach shot consists of one or more of hitting close to the pin or hitting the green.

13. The method of claim 11, wherein the golfer's critical playing characteristic of shot accuracy is evaluated by considering whether a typical drive consists of one or more of hitting the fairway or is out of play.

14. The method of claim 1, wherein the steps of determining the golfer's critical playing characteristic and prioritizing ball performance characteristics is performed by a CD-ROM programmed to present a golfer with a series of questions about their golf game that aids in identifying said golfer's style of play and golf ball performance needs.

15. The method of claim 1, wherein the steps of determining the golfer's critical playing characteristic and prioritizing ball performance characteristics is performed by a world wide web site programmed to present a golfer with a series of questions about their golf game that aids in identifying said golfer's style of play and golf ball performance needs.

16. The method of claim 1, wherein the steps of determining the golfer's critical playing characteristic and prioritizing ball performance characteristics is performed by using a computer program stored on one or more of a plurality of data storage devices.

17. A golf ball fitting system for matching a golfer to a particular golf ball selected from a predetermined set of golf balls comprising:

a) a computing device;

b) an input device associated with the computing device for receiving input from a golfer and transmitting it to said computing device;

c) a computer program associated with said computing device and said input device comprising at least a first set of predetermined interactive questions for determining the golfer's critical playing characteristics;

d) a second set of predetermined interactive questions taking into account the golfer's critical playing characteristics for determining and prioritizing ball performance characteristics; and e) wherein said computer program selects a preferred ball from the set of balls to best match the golfer's critical playing characteristics and ball performance characteristics.

18. The golf ball fitting system of claim 17, wherein the first set of predetermined interactive questions for detaining the critical playing characteristics include one or more of the following playing characteristics: shot distance for a predetermined club, shot shape, shot accuracy, shot consistency, and short game ability.

19. The golf ball fitting system of claim 17, wherein the opposing ball performance characteristics comprise one or more of the following: distance, spin, durability, and feel.

20. The golf ball fitting system of claim 19, wherein the ball performance characteristics comprises:

a) golf ball spin versus golf ball durability;

b) golf ball spin versus golf ball distance; or c) golf ball feel versus golf ball distance.

* * * * *